US009814639B2

(12) United States Patent
Hollyoak et al.

(10) Patent No.: US 9,814,639 B2
(45) Date of Patent: Nov. 14, 2017

(54) APPARATUS FOR SELECTIVELY SUPPORTING A BED SECTION

(71) Applicant: HUNTLEIGH TECHNOLOGY LIMITED, Dunstable (GB)

(72) Inventors: Stephen Hollyoak, Kingswinford (GB); Robert Hugh Jones, Tipton (GB)

(73) Assignee: Huntleigh Technology Limited (GB)

( * ) Notice: Subject to any disclaimer, the term of this patent is extended or adjusted under 35 U.S.C. 154(b) by 151 days.

(21) Appl. No.: 14/415,279

(22) PCT Filed: Jul. 4, 2013

(86) PCT No.: PCT/GB2013/051773
§ 371 (c)(1),
(2) Date: Jan. 16, 2015

(87) PCT Pub. No.: WO2014/013222
PCT Pub. Date: Jan. 23, 2014

(65) Prior Publication Data
US 2015/0182398 A1 Jul. 2, 2015

(30) Foreign Application Priority Data
Jul. 18, 2012 (GB) ..... 1212749.4

(51) Int. Cl.
*A61G 7/015* (2006.01)

(52) U.S. Cl.
CPC ..... *A61G 7/015* (2013.01)

(58) Field of Classification Search
CPC ..... A47C 20/04; A47C 20/043; A47C 20/045; A61G 1/00; A61G 1/017; A61G 1/04; A61G 7/002; A61G 7/015
See application file for complete search history.

(56) References Cited

U.S. PATENT DOCUMENTS 879,442 A 2/1908 Clemetson
2,026,153 A * 12/1935 Wright ..... A47C 20/08 5/618

(Continued)

FOREIGN PATENT DOCUMENTS

CH 533970 A 4/1973
CN 201481696 U 5/2010

(Continued)

OTHER PUBLICATIONS

International Search Report and Written Opinion issued for corresponding International Application No. PCT/GB2013/051773, dated Sep. 13, 2013, 11 pages.

(Continued)

*Primary Examiner* — Nicholas Polito
(74) *Attorney, Agent, or Firm* — The Webb Law Firm

(57) ABSTRACT

Apparatus for selectively supporting a section (9) of an articulated bed platform in a raised position relative to a frame of the bed includes a stay (11) having engagement member (13) which is able to reciprocate in a guide (15) provided on the frame. Locking means allow the engagement member (13) to be selectively engaged, such that the engagement member (13) either reciprocates in the guide (15), or is prevented from doing so. When the engagement member (13) is engaged, the stay (11) can support the bed section (9) in the raised position.

21 Claims, 7 Drawing Sheets

(56) References Cited

U.S. PATENT DOCUMENTS

| | | | | |
|---|---|---|---|---|
| 2,968,050 | A | 1/1961 | Martin | |
| 3,800,338 | A * | 4/1974 | Smith | A61G 7/015 297/377 |
| 5,706,536 | A * | 1/1998 | Krauska | A61G 7/015 5/618 |
| 6,351,861 | B1 * | 3/2002 | Shows | A61G 7/012 5/613 |
| 8,910,329 | B2 | 12/2014 | Turner et al. | |
| 2008/0111414 | A1 * | 5/2008 | Sulzer | A47C 3/03 297/354.1 |

FOREIGN PATENT DOCUMENTS

| | | | |
|---|---|---|---|
| EP | 0 752 241 | A2 | 1/1997 |
| EP | 1810650 | A2 | 7/2007 |
| EP | 2 186 441 | A1 | 5/2010 |
| ES | 2110340 | A1 | 2/1998 |
| GB | 569758 | A | 6/1945 |

OTHER PUBLICATIONS

Great Britain Search Report issued for corresponding GB Application No. GB1212749.4, dated Sep. 28, 2012, 3 pages.

* cited by examiner

APPARATUS FOR SELECTIVELY SUPPORTING A BED SECTION

CROSS-REFERENCE TO RELATED APPLICATIONS

This application is a nationalization of International Patent Application No. PCT/GB2013/051773, filed on Jul. 4, 2013, pursuant to 35 USC §371, which in turn claims benefit of priority to Patent Application No. GB1212749.4, filed on Jul. 18, 2012, the entire disclosures of which are expressly incorporated by reference herein.

BACKGROUND OF THE INVENTION

1. Field of the Invention

The present invention relates to apparatus for selectively supporting a bed section, and in particular to apparatus suitable for use with a hospital bed. More particularly, the present invention relates to apparatus for supporting a section of an articulated bed platform in a raised position such that the platform can be placed in a number of different positions.

2. Description of the Related Technology

Hospital beds often include an articulated platform comprising a number of separate sections which can be independently raised, thus enabling the platform to be arranged in a number of positions to suit the needs of the occupant and/or medical staff.

Typically, three sections are provided along the length of the platform; a backrest section which supports the occupant's upper body, a thigh section which supports the occupant's thighs (i.e. supports the occupant between the hips and the knees) and a calf section which supports the occupant below the knees. In a typical arrangement, a first end of the backrest section (that is the end adjacent the occupant's head) can be raised such that the occupant's torso can be supported with the occupant in a sitting position. The first end of the thigh section (that is the end disposed towards the head end of the bed) is pivotally attached to the bed frame at platform level and the second end of the thigh section (that is the end disposed towards the foot end of the bed) can be raised, such that the occupant's thighs can be supported when the occupant's legs are bent at the knee. The first end of the calf section is pivotally attached to the second end of the thigh section, and the second end of the calf section can be raised from the flat platform position.

When the second end of the thigh section and thus the first end of the calf section are in a raised position, and the second end of the calf section is not raised, both the occupant's thighs and calves are supported when the occupant's legs are bent at the knee. This is known as the Fowler position.

When the second end of the thigh section and thus the first end of the calf section are in a raised position, and the second end of the calf section is also in a raised position, both the occupant's thighs and calves are supported when the occupant's calves are raised and substantially parallel to the bed frame. This is known as the vascular position.

When the bed is arranged in the vascular position, a support mechanism is required to support the second end of the calf section in the raised position. Known designs of calf section supports include the use of two telescopic multi-position ratchet assemblies, one disposed generally along each long side of the bed. There are however disadvantages to this solution. First, the ratchet assemblies are not strong enough. This is partially because of the construction, but also because each ratchet assembly is not linked to the other, meaning that any load applied to one side of the bed is only carried by one of the ratchets. Second, when the thigh and calf sections of the bed are lowered to the flat platform position, the ratchet assemblies extend and lock so that when the thigh section is raised again the calf section is moved directly into the vascular position. This is disadvantageous when raising the occupant's legs into the vascular position is medically contra-indicated. Third, such ratchet assemblies are difficult to clean.

The present invention seeks to provide an improved mechanism for supporting a section of an articulated bed platform in a raised position.

SUMMARY OF THE INVENTION

According to an aspect of the present invention, there is provided apparatus for selectively supporting a section of an articulated bed platform in a raised position relative to a frame of the bed, the apparatus including a stay having a first end including an engagement member which is able to reciprocate in guide means provided on the frame and a second end pivotally attached to the bed section, and locking means for selectively engaging the engagement member. The locking means includes a lever moveable between a first position in which the engagement member is prevented from engaging the locking means and is thus free to reciprocate in the guide means, and a second position in which the engagement member engages the locking means thus preventing the engagement member from reciprocating in the guide means and thereby enabling the stay to support the bed section in the raised position.

This arrangement provides a single simple mechanism for stably supporting the bed section in the raised position, and allows an operator to easily move the bed platform from a flat platform position into the Fowler position or the vascular position, or to move the platform between the Fowler position and the vascular position. Advantageously, the arrangement enables the bed to be moved from the flat platform position to the Fowler position without the bed having to be initially moved into the vascular position.

The engagement member may include a stay pin, and the guide means may include a plate member having a longitudinal recess in which the stay pin can reciprocate. This reciprocating action allows the bed section to be lowered (so as to present a substantially flat platform with the other bed section(s), or to place the bed platform in the Fowler position) when the stay pin is located at one end of the longitudinal recess, and raised (so as to place the bed platform in the vascular position) when the stay pin is located at the second end of the longitudinal recess.

The locking means may include a detent in the longitudinal recess, forming a shoulder against which the stay pin can engage to lock the stay in position. The detent may be provided at the second end of the longitudinal recess, such that the stay pin is locked in position at the second end of the longitudinal recess. The lever may be pivotable between the first and second positions, and may be shaped such that when the lever is in the first position a contact surface of the lever covers the detent, and when the lever is in the second position the detent is exposed. Thus, when the lever is in the first position the stay pin is able to reciprocate in the longitudinal recess without engaging the shoulder of the detent, and when the lever is in the second position the stay pin is able to engage the shoulder of the detent thereby locking the stay in position.

The lever may be biased towards the first position by biasing means, which may include a spring finger forming a part of the lever.

When the lever is in the second position and the stay pin is engaged with the shoulder of the detent, the lever may be moved towards the first position by a pushing force exerted by a pushing member provided on the bed section, as the bed section is lowered. This action causes the contact surface of the lever to contact the stay pin and move this away from engagement with the shoulder and out of the detent, so that the stay pin can once again reciprocate in the longitudinal recess. The contact surface of the lever again covers the detent to prevent the stay pin from engaging the shoulder of the detent once more. Thus, as an operative moves the bed platform from the vascular position to the flat position, the pushing member causes the lever to move the stay pin out of its locked position, thus enabling the stay pin to reciprocate in the longitudinal recess and enabling the bed section to be lowered or raised as required.

Advantageously, the stay includes a load bearing finger which, as the bed section is lowered as described above, contacts a part of the bed frame. This removes the load from the stay, thus enabling the stay pin to be moved away from engagement with the shoulder and out of the detent more easily.

In an embodiment, the bed section is a calf section which supports the calves of an occupant.

According to another aspect of the present invention, there is provided a bed including a frame and a platform, the platform including a thigh section and a calf section, wherein the thigh section has a first end pivotally attached to the frame such that a second end thereof may be raised relative to the frame, and wherein the calf section has a first end which is pivotally attached to the second end of the thigh section such that the calf section may be raised relative to the frame. The bed further includes a stay having a first end including an engagement member which is able to reciprocate in guide means provided on the frame and a second end pivotally attached to the bed section, and locking means for selectively engaging the engagement member, the locking means including a lever moveable between a first position in which the engagement member is prevented from engaging the locking means and is thus free to reciprocate in the guide means, and a second position in which the engagement member engages the locking means thus preventing the engagement member from reciprocating in the guide means and thereby enabling the stay to support the bed section in the raised position.

BRIEF DESCRIPTION OF THE DRAWINGS

A preferred embodiment of the present invention will now be described, by way of example only, with reference to the accompanying drawings, in which.

Figure 1:
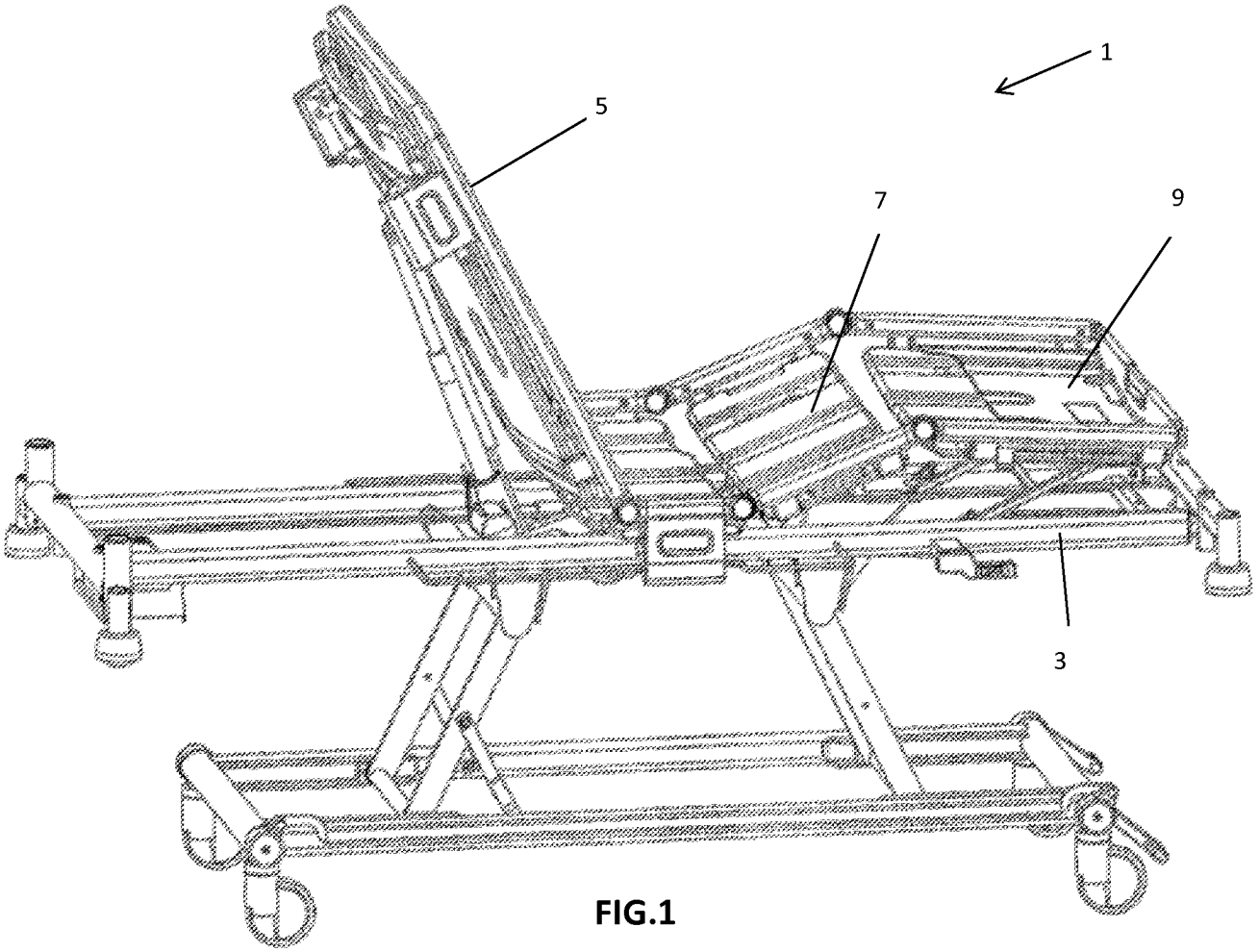
FIG. 1 is a side perspective view of a bed in accordance with an embodiment of the present invention, wherein the bed platform is in the vascular position.

The components in the drawings are not necessarily to scale, emphasis instead being placed upon illustrating the principles of the teachings herein.

DESCRIPTION OF THE PREFERRED EMBODIMENTS

In the description below the phrase "first end" is used to denote the end of any component of the bed which is disposed towards the end of the bed at which an occupant's head would be positioned in normal use, and the phrase "second end" is used to denote the end of any component of the bed which is disposed towards the end of the bed at which an occupant's feet would be positioned in normal use.

FIG. 1 shows a bed 1 in accordance with an embodiment of the present invention. The bed 1 is suitable for use in a hospital. The bed mattress has been removed for clarity, such that the platform and the frame 3 can be seen in greater detail. The platform is articulated and comprises a backrest section 5, a thigh section 7 and a calf section 9. The first end of the backrest section 5 can be raised such that an occupant's torso can be supported with the occupant in a sitting position. The first end of the thigh section 7 is pivotally attached to the bed frame 3 and the second end of the thigh section 7 can be raised, such that an occupant's thighs can be supported when the occupant's legs are bent at the knee. The first end of the calf section 9 is pivotally attached to the second end of the thigh section 7, and the second end of the calf section 9 can be raised away from the frame 3.

Figure 2:
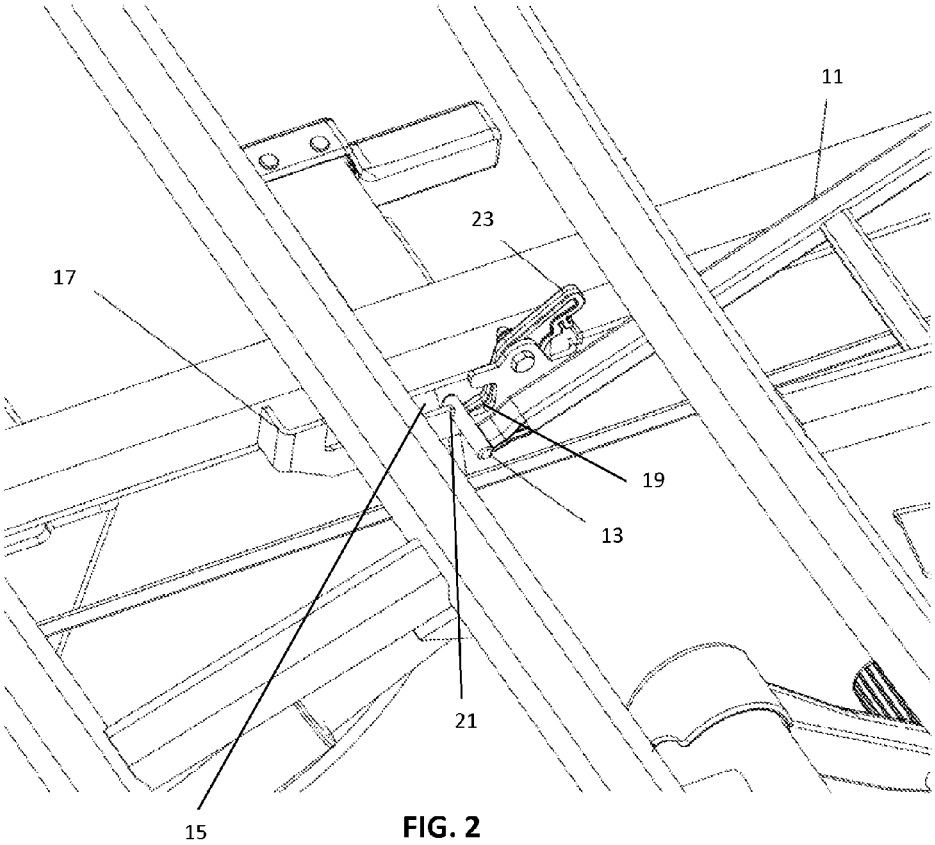
FIG. 2 is a perspective view showing the locking mechanism of the bed of FIG. 1 in greater detail.

Referring to FIG. 2, the mechanism by which the calf section 9 can be supported in a raised position comprises a stay 11 having a stay pin 13 at a first end and being pivotally attached to the calf section 9 at a second end (not shown in FIG. 2). The stay pin 13 can reciprocate in a slot or guide 15 provided in a guide plate 17 forming part of the bed frame. The slot has a recess or detent 19 which provides a shoulder 21 with which the stay pin 13 can engage, thus enabling the stay 11 to support the calf section 9 in the raised position.

A lever 23 can be pivoted between two positions, one position in which the recess 19 is covered such that the stay pin 13 cannot engage against the shoulder 21, and a second position in which the recess 19 is exposed such that the stay pin 13 can drop into the recess 19 and engage the shoulder 21. The action of the lever 23 will be described more fully below.

With the exception of the thigh section 7, the calf section 9 and the stay 11, all other components of the bed in this embodiment exist as pairs on each side of the bed. In other embodiments, there may be provided a pair of stays, one on each side of the bed, or the bed may be provided a plurality of stays.

Figures 3A, 3B:
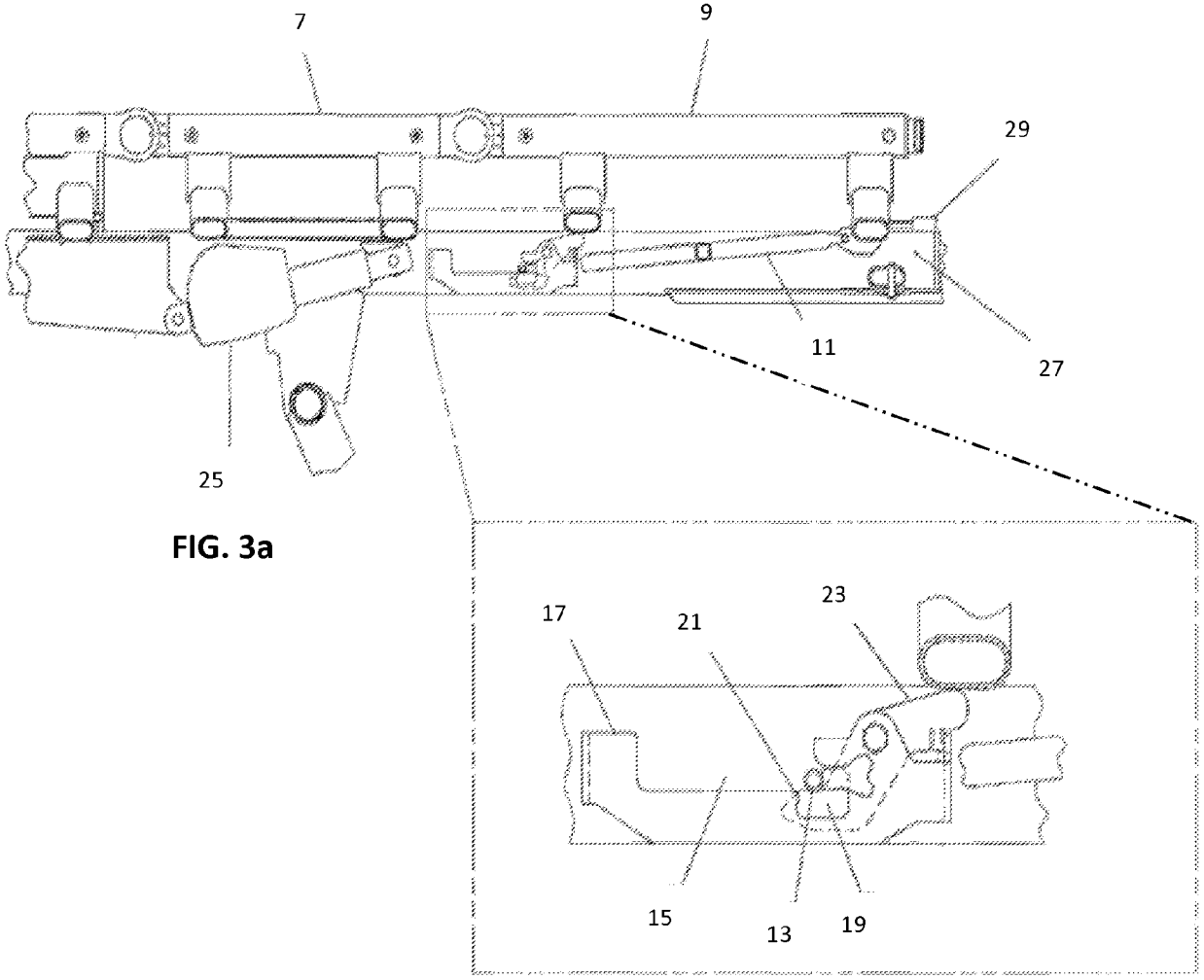
FIG. 3*a* is a cross sectional side view of part of the bed of FIG. 1, wherein the bed platform is in the flat position.
FIG. 3*b* is a cross sectional side view showing a detailed part of the bed of FIG. 3*a;*

Referring now to FIGS. 3*a* and 3*b*, these Figures show the bed platform in the flat position. The thigh section 7 can be pivotally raised by an actuator 25 of known form. The calf section 9 can be raised at its first end by the thigh section 7, and the second end of the calf section 9 can either slide along the longitudinal member 27 of the frame, or be raised pivotally by a stay 11. These actions place the platform in the Fowler position or the vascular position respectively, dependent on which function has been selected by the operator. A protective low friction component in the form of a calf section guide 29 is fitted to the non-pivoting end of the calf section 9, to prevent damage to the coating of the longitudinal member 27. Because both sides of the calf section 9 are supported by a component, that is the stay 11, torsional stiffness of the calf section 9 is increased.

When thigh section 7 is raised, the calf section 9 moves in one of two ways, as described above. This is achieved by allowing the stay pin 13 of the stay 11 either to slide horizontally in the slot 15 of the guide plate 17, or to engage against the shoulder 21 of the recess 19. These two positions of the stay pin 13 are obtained by the operation of pivoting lever 23.

Figure 4:
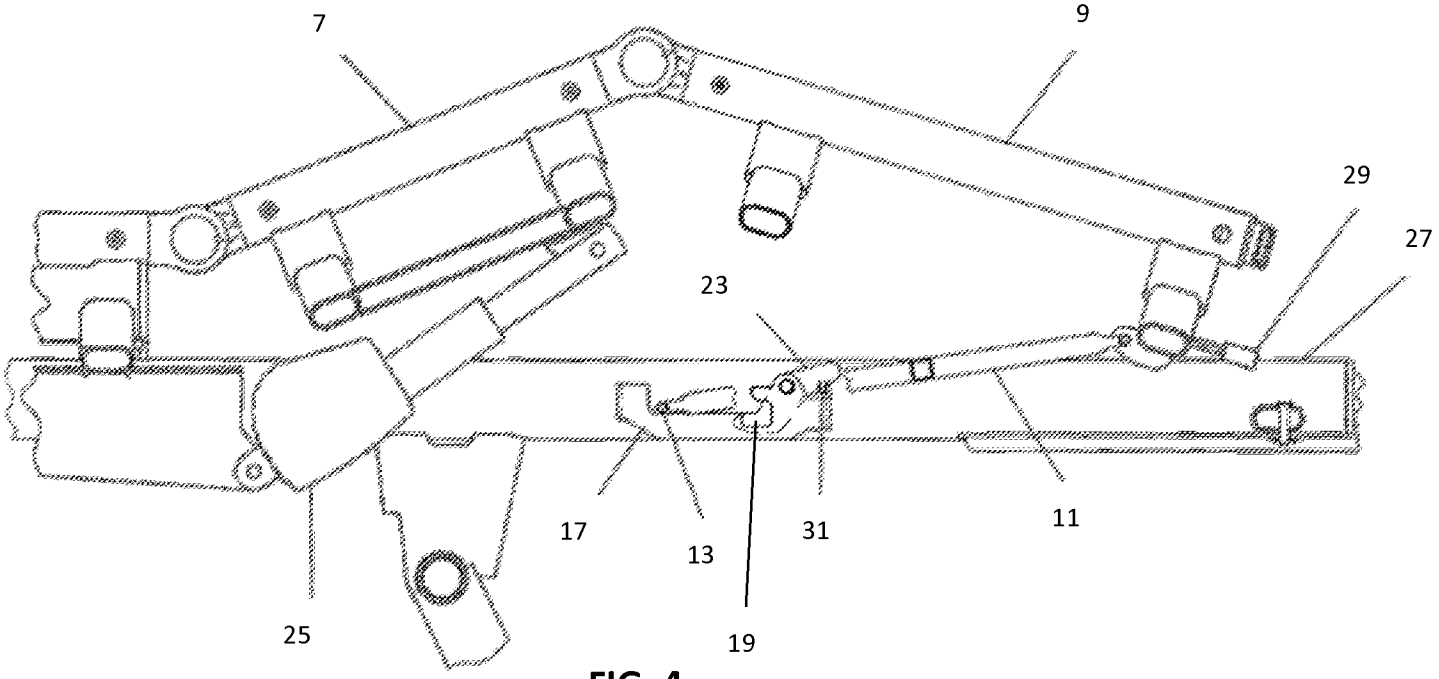
FIG. 4 is a cross sectional side view of the bed of FIG. 1, wherein the bed platform is in the Fowler position.

FIG. 4 shows the thigh section 7 and calf section 9 of the bed with the platform in the Fowler position. When in this position, the lever 23 covers the recess 19 such that the stay pin 13 cannot engage against the shoulder 21. The stay 11 therefore cannot drop into the recess 19 and raise the calf section 9. The lever 23 incorporates a friction device, in this embodiment an integral spring finger element 31, which provides enough resistance to support the free end of the stay 11. In this position, raising the knees does not raise a patient's calves.

Figure 5:
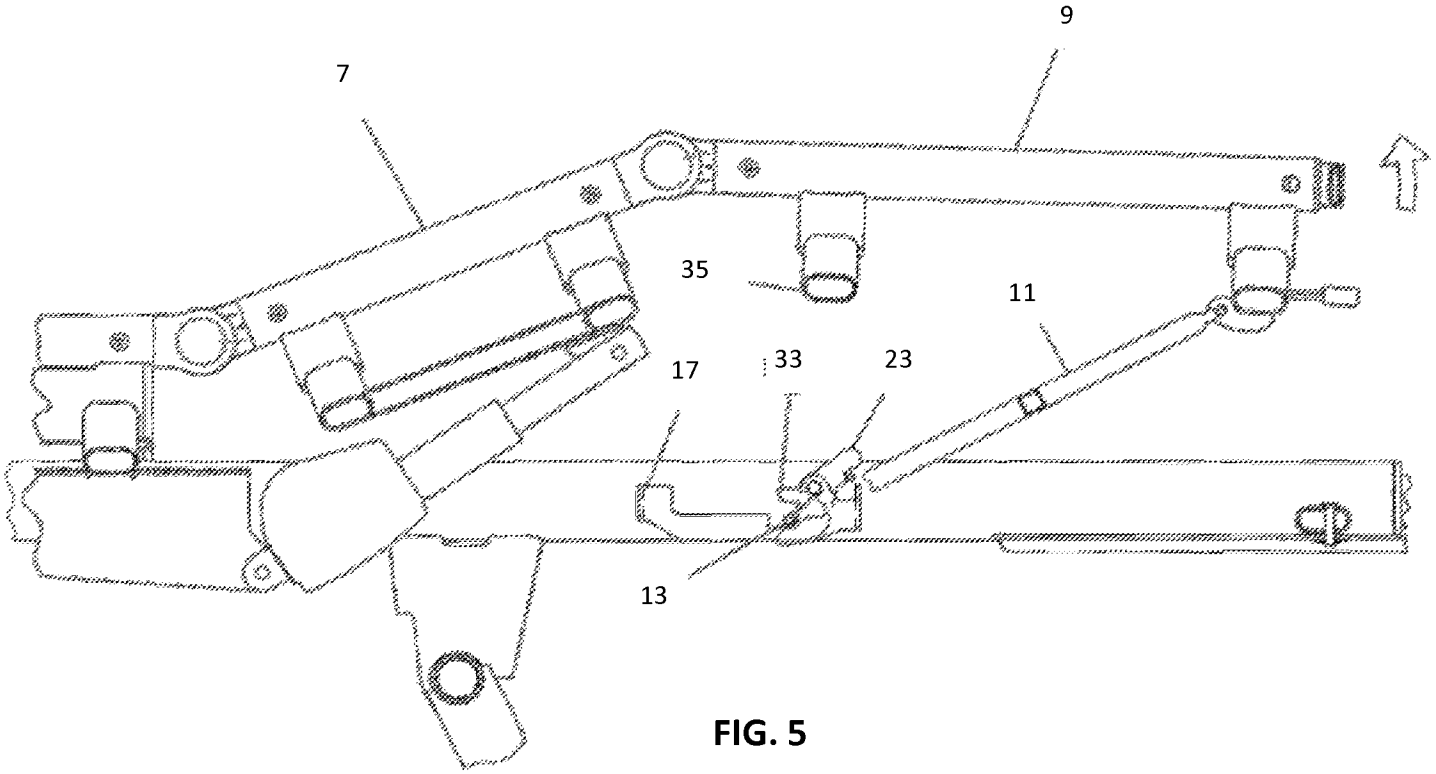
FIG. 5 is a cross sectional side view of the bed of FIG. 1, wherein the bed platform is in the process of being moved from the Fowler position to the vascular position.
Figure 6:
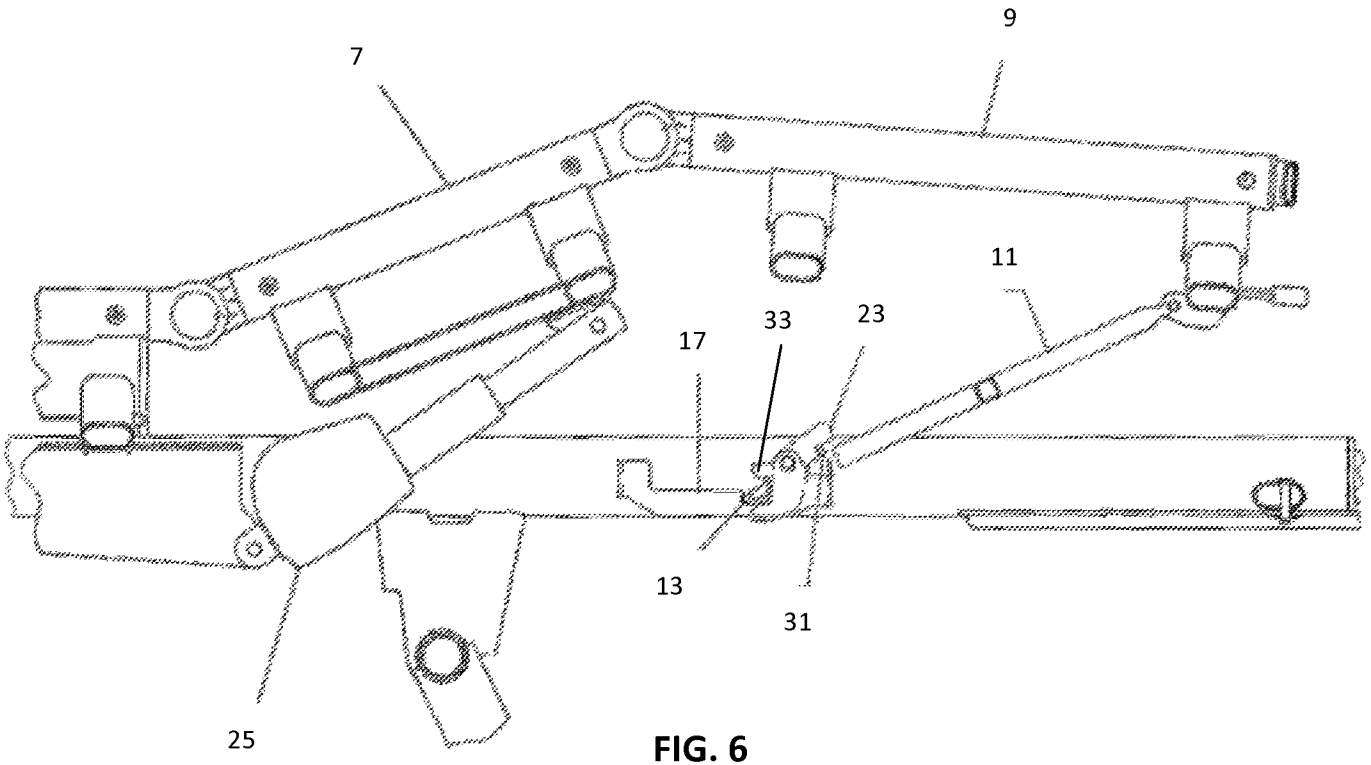
FIG. 6 is a cross sectional side view of the bed of FIG. 1, wherein the bed platform is in the vascular position.

Referring now to FIGS. 5 and 6, when it is required to move the platform into the vascular position, first the thigh section 7 is partially raised then the calf section 9 is manually pivoted upwards, in this embodiment by hand but in other embodiments potentially with an actuator similar to actuator 25. This action moves the stay pin 13 backwards (that is towards the foot end of the bed), thereby trapping it against the lever 23 and the projection 33 on the guide plate 17. The force generated by this action rotates the lever 23 counter-clockwise, thereby exposing the recess 19. Then, when the calf section 9 is lowered by the operator, the stay pin 13 drops into the recess 19 and engages against the shoulder 21, such that the calf section 9 is supported in a raised position by the stay 11. The thigh section 7 can be now be fully raised, if required, together with the calf section 9, into the vascular position as shown in FIG. 6.

Figure 7:
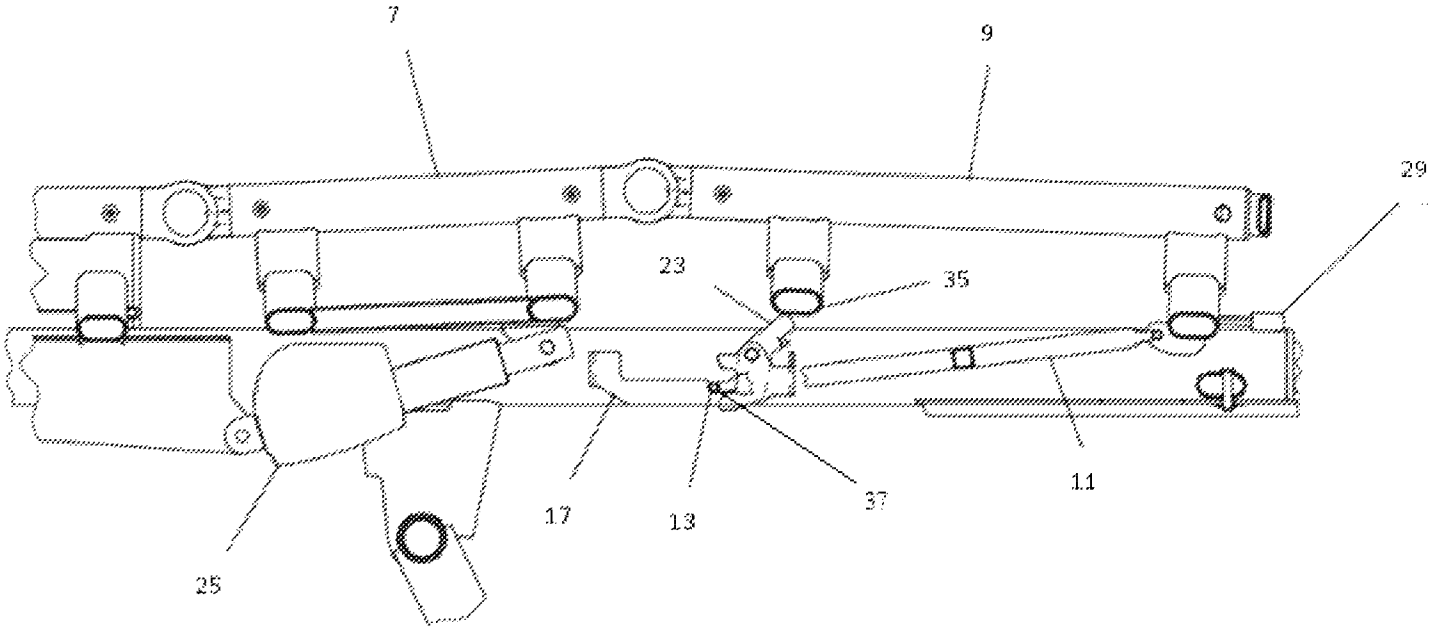
FIG. 7 is a cross sectional side view of the bed of FIG. 1, wherein the bed platform is in the process of being lowered so as to re-engage the Fowler position.

When the vascular position is no longer required, the bed platform can be automatically switched to the Fowler position by fully lowering the thigh section 7 and the calf section 9 and raising these sections again. Referring to FIG. 7, this switching action is achieved through the lever 23 being rotated clockwise by a pushing member 35 forming a part of a cross member provided on the calf section 7. This pushing member 35 pushes against the lever 23 when the calf section 9 is lowered. At this point, the calf section guide 29 contacts the longitudinal member 27 of the frame, thus removing the load from the stay 11. As the calf section 9, and thus the pushing member 35, continues to be lowered, the lever 23 is rotated clockwise. This clockwise rotation enables a contact surface 37 of the lever 23 to contact the stay pin 13, and lift the stay pin 13 out of the recess 19. When the sections 7, 9 are flat the lever 23 is again held in position and will prevent the stay pin 13 from engaging the shoulder 21.

The arrangement described above provides a single mechanism which can be simply operated to stably support the calf section in the raised position. The calf section is supported by a stay which can be selectively locked in position, allowing the second end of the calf section to be selectively raised as required.

The invention claimed is:

1. Apparatus for selectively supporting a section of an articulated bed platform in a raised position relative to a frame of the bed, the apparatus including:

a stay having a first end including a protrusion extending from a portion of the stay and configured to reciprocate in a guide of the frame, the stay further comprising a second end that opposes the first end and is pivotally attached to a bed section, and wherein the stay comprises a load bearing finger which, when the bed section is lowered, contacts a part of the frame so as to remove a load from the stay; and a locking assembly operatively associated with the protrusion, the locking assembly comprising the guide and a lever moveable between a first position in which the lever occludes a recess of the guide, thus allowing the protrusion to reciprocate along a length of the guide, and a second position in which the lever does not occlude the recess, when the protrusion is situated within the recess it is prevented from reciprocating along the length of the guide thereby allowing the stay to support the bed section in the raised position.

2. Apparatus according to claim 1, wherein the protrusion is a stay pin.

3. Apparatus according to claim 2, wherein the guide is a plate having a longitudinal slot in which the stay pin can reciprocate.

4. Apparatus according to claim 3, wherein the recess is defined in the slot and forms a shoulder against which the stay pin can engage to lock the stay in position.

5. Apparatus according to claim 4, wherein the recess is provided at an end of the longitudinal slot, such that the stay pin is locked in position at that end of the longitudinal slot.

6. Apparatus according to claim 1, wherein the lever is mounted to the guide at one end and pivotably movable between the first and second positions.

7. Apparatus according to claim 1, wherein the lever is biased towards the first position by a biasing member including a spring finger forming a part of the lever.

8. Apparatus according to claim 1, further comprising a bed protrusion extending from the bed section and oriented to exert a pushing force on the lever when the lever is in the second position to move the lever from the second position to the first position.

9. A bed including:

a frame;

a platform for supporting an individual, the platform including a thigh support section and a calf support section, wherein the thigh support section has a first end pivotally attached to the frame such that a second end thereof may be raised relative to the frame, and wherein the calf support section has a first end which is pivotally attached to the second end of the thigh support section such that the calf support section may be raised relative to the frame; and the apparatus for selectively supporting a section of an articulated bed platform in a raised position relative to a frame of the bed of claim 1.

10. A bed according to claim 9, in which the protrusion is a stay pin.

11. A bed according to claim 10, wherein the guide is a plate having a longitudinal slot in which the stay pin can reciprocate.

12. A bed according to claim 11, wherein the recess is defined in the slot, forming a shoulder against which the stay pin can engage to lock the stay in position.

13. A bed according to claim 9, wherein the lever is pivotable between the first and second positions.

14. A bed according to claim 9 , wherein the lever is biased towards the first position by a biasing member.

15. A bed according to claim 14, wherein the biasing member includes a spring finger forming a part of the lever.

16. A bed according to claim 9, wherein the calf support section includes a bed protrusion extending from the bed section and oriented to exert a pushing force on the lever when the lever is in the second position to move the lever from the second position to the first position.

17. A system for selectively supporting a section of a bed platform in a raised position relative to a frame of the bed, the system comprising:

a stay having a first end comprising an protrusion and a second end pivotally attached to a bed section, wherein the protrusion is configured to reciprocate in a guide of the frame;

a load bearing finger operatively associated with the stay and a part of the frame that supports a load of the stay when the bed section is lowered; and a locking assembly operatively associated with the protrusion, the locking assembly comprising the guide and a lever pivotally movable relative to the guide between a first position that allows the protrusion to reciprocate along a length of the guide, and a second position in which the protrusion is securable in a portion of the guide so as to allow the stay to support the bed section in the raised position.

18. An apparatus for selectively supporting a section of a bed platform in a raised position relative to a frame of the bed, the apparatus comprising:

a stay having a first end comprising a protrusion extending from a portion of the stay and configured to reciprocate in a guide of the frame, the stay further comprising a second end that opposes the first end and is pivotally attached to a bed section;

a locking assembly operatively associated with the protrusion, the locking assembly comprising: the guide and a spring biased lever pivotally movable relative to the guide between a first position that allows the protrusion to reciprocate along a length of the guide and a second position in which the protrusion is securable in a portion of the guide so as to allow the stay to support the bed section in the raised position, wherein the lever is biased to assume the first position; and a bed protrusion extending from the bed section and capable of removably engaging the lever so as to move the lever from the first position to the second position as the bed section is lowered.

19. The apparatus of claim 18, wherein the bed protrusion is arranged relative to the lever such that the bed protrusion pushes against the lever when the bed section is lowered to move the lever from the first position to the second position.

20. The apparatus of claim 18, wherein the bed protrusion is configured as a load bearing finger operatively associated with the stay and a part of the frame that supports a load of the stay when the bed section is lowered.

21. An apparatus for selectively supporting a section of a bed platform in a raised position relative to a frame of the bed, the apparatus comprising:

a stay having a first end comprising a protrusion extending from a portion of the stay and configured to reciprocate in a guide of the frame, the stay further comprising a second end that opposes the first end and is pivotally attached to a bed section;

a locking assembly operatively associated with the protrusion, the locking assembly comprising: the guide and a spring biased lever pivotally movable relative to the guide between a first position that allows the protrusion to reciprocate along a length of the guide and a second position in which the protrusion is securable in a portion of the guide so as to allow the stay to support the bed section in the raised position, wherein the lever is biased to assume the first position; and a bed protrusion extending from the bed section and operatively associated with the lever so as to move the lever from the first position to the second position as the bed section is lowered, thereby contracting a part of the frame so as to remove a load from the stay.

* * * * *